United States Patent [19]

Hofmann et al.

[11] Patent Number: 4,507,021

[45] Date of Patent: Mar. 26, 1985

[54] PROFILE ELEMENT FOR MINING APPLICATIONS

[75] Inventors: Heinz Hofmann, Dortmund; Wilhelm Striepeke, Bochum; Manfred Werner, Lippstadt-Bad Liesborn; Herbert Kleinherne; Christoph Zillessen, both of Recklinghausen, all of Fed. Rep. of Germany

[73] Assignee: Estel Hoesch Werke Aktiengesellschaft, Dortmund, Fed. Rep. of Germany

[21] Appl. No.: 500,939

[22] Filed: Jun. 16, 1983

Related U.S. Application Data

[63] Continuation of Ser. No. 239,115, Feb. 27, 1983, abandoned.

[51] Int. Cl.[3] ..... E21D 11/18

[52] U.S. Cl. ..... 405/288; 403/363

[58] Field of Search ..... 405/288; 248/351; 403/363; 52/86

[56] References Cited

U.S. PATENT DOCUMENTS

| | | | |
|---|---|---|---|
| 2,713,774 | 7/1955 | Heintzmann et al. | 405/288 |
| 3,022,100 | 2/1962 | Heintzmann | 405/288 X |
| 3,097,727 | 7/1963 | Jasper et al. | 405/288 X |
| 3,168,815 | 2/1965 | Blenkle et al. | 405/288 |

FOREIGN PATENT DOCUMENTS

| | | | |
|---|---|---|---|
| 2388988 | 12/1978 | France | 405/288 |

*Primary Examiner*—Cornelius J. Husar
*Assistant Examiner*—Nancy J. Stodola
*Attorney, Agent, or Firm*—Max Fogiel

[57] ABSTRACT

An arcuate or circular profile element of generally V-shaped cross-section has a curved bottom wall, arcuate sidewalls having free edges, and laterally projecting flanges projecting from the free edges. By choosing specific relationships between the thickness of the different parts of the element, lighter-weight elements can be used to withstand the same loads as before, or elements having the same weight as before can be used to support heavier loads.

9 Claims, 1 Drawing Figure

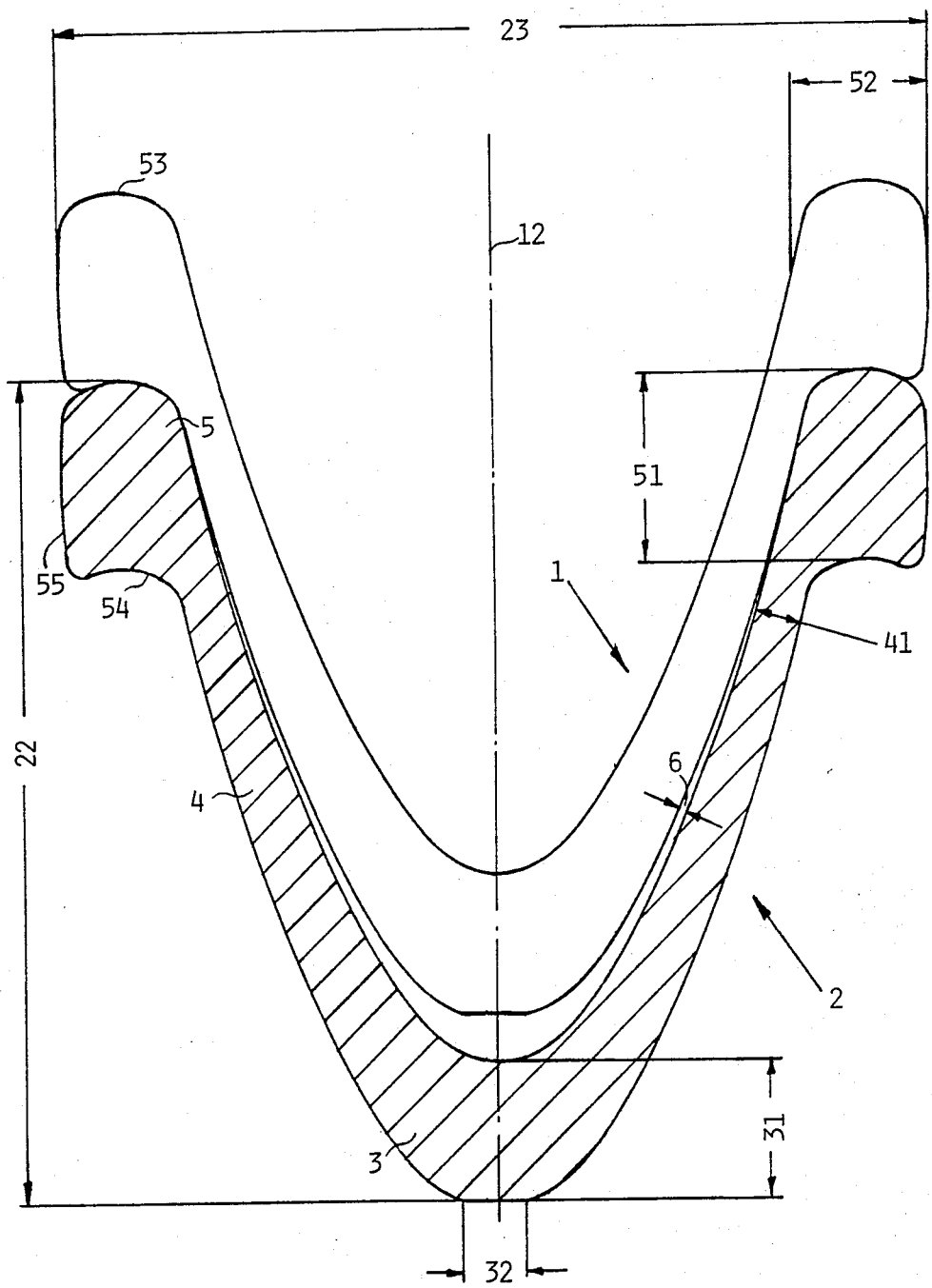
23
52
53
12
5
51
55
54
1
41
22
6
4
2
31
3
32

PROFILE ELEMENT FOR MINING APPLICATIONS

This is a continuation of application Ser. No. 239,115 filed Feb. 27, 1983, abandoned.

BACKGROUND OF THE INVENTION

The present invention relates to a profile element in general, and more particularly to a profile element for mining application.

Still more particularly, the invention relates to a profile element for the yieldable support of mining galleries and the like.

Profile elements for yieldable support of mining galleries and the like are used in many underground applications. The profile elements are configurated as circular or arcuate elements composed of two nested-together identical members which combine the region of overlap, are so in yieldable contact with one another that when the forces exerted upon them by the overburden exceeds a certain limit, they can shift relative to one another to a limited extent, reducing the length of the arc and thus avoiding premature plastic deformation by the forces exerted from the overburden.

Two different basic types of these profile elements are known. One is described in German Pat. No. 1,010,031 and is known as the so-called "bell profile". In this profile the bottom portion is arcuately curved and merges essentially parabolically into tapering sidewalls which are terminated by outwardly directed flanges. A particular advantage of this construction is that the bottom wall is substantially reinforced in outward direction. Also, the contact area on sliding of the profile members of the profile element relative to one another is located at the sidewalls in this construction.

The second embodiment is known from German Pat. No. 1,166,121 and known as the so-called "TH-Profile". This embodiment has as an essential feature the fact that its bottom wall portion is flattened on the outer side and merges into thinner sidewalls which are also terminated by outwardly directed flanges. In this embodiment, the glide surface on shifting of the profile members relative to one another is between the flanges rather than between the sidewalls.

Both known types of profile elements have advantages. However, they also have disadvantages in that they do not meet the optimum requirements relative to the relationship of material-weight used to load supporting capability. The load supporting capability of such elements is determined in the Federal Republic of Germany and in other countries by DIN 21 538. According to this industrial standard the bending moment, which causes on bending of the profiles at a support of 1000 mm a permanent deformation of 50 to 100 mm, is determinative for the question whether or not such a profile does or does not meet the requirements of DIN 21 538.

SUMMARY OF THE INVENTION

It is an object of the present invention to overcome the disadvantages of the prior art.

A more particular object of the present invention is to provide an improved profile element of the type in question which has a lesser cross-section than those known from the prior art, but is capable of achieving the same load supporting capability according to DIN 21 538 as the prior-art profiles.

In pursuance of these objects, and of others which will become apparent hereafter, one feature of the invention resides in an elongated profile element of arcuate cross-section, particularly for supporting mining excavations, including a member having a reinforced curved bottom wall and arcuate sidewalls provided with free edges and flanges which project outwardly thereof. In such a profile element the improvement according to the present invention comprises a mean thickness of the flanges which is equal to between 0.9–1.1 times the thickness of the bottom wall, a height of the flanges which is equal to 1.25 to 1.50 of the bottom wall thickness, and a minimum sidewall thickness which is equal to 0.30–0.35 times the bottom wall thickness. The bottom wall has a surface which faces outwardly of the element and is provided with a flat having transversely of the elongation of the element a width which is at most equal to the bottom wall thickness, and the element has in the direction transverse to its elongation a width which is equal to between 0.9 and 1.2 of the overall height of the element.

An element according to the present invention thus is capable of supporting the same amount of weight as those in the prior art (and meeting the requirements of DIN 21 538) while having a lesser cross-section and requiring less material and thus also having a reduced weight. Conversely, if an element according to the present invention is made with the same cross-section and the same amount of material as those of the prior art, it is capable of supporting more weight than the prior-art elements.

In a particularly advantageous embodiment the invention provides that in the overlap region of two of the members which together make up one of the profile elements the gap between the outer wall surface of the sidewalls of the inner member and the inner wall surface of the sidewalls of the outer member, increases continuously from a starting width at the flanges in the direction towards the bottom wall.

It is further advantageous that the flange terminate in a convex ellipsis and that the side of the flange which faces toward the sidewall be terminated by a similar but concave ellipsis. It is further possible for the concave elliptical flange delimination to be formed by a slightly larger ellipsis and/or with an ellipsis center point which is slightly offset towards the central plane of symmetry of the profile element than the convex elliptical flange delimination. An embodiment of the invention may also be so constructed that the outer flange delimination is defined by two slightly outwardly inclined groove-shaped surface portions.

The invention will hereafter be described with reference to an exemplary embodiment. It is to be understood, however, that this is by way of explanation only and is not to be considered limiting of the inventive concept which is expressed authoritatively in the appended claims.

BRIEF DESCRIPTION OF THE DRAWING

The single FIGURE is a somewhat diagrammatic cross-section through a profile element embodying the invention.

DESCRIPTION OF THE PREFERRED EMBODIMENTS

Referring now to the drawing in detail it will be seen that it shows a cross-section through an elongated profile element which is of arcuate cross-section and which may in a plane normal to the plane of the FIGUREG, be either circular or simply arcuately shaped. In any case, the element according to the invention has an inner profile member 1 and an outer profile member 2. Each of these members has a bottom wall portion 3, two sidewall portions 4 which merge into the bottom wall portion 3, and two flanges 5 which project laterally outwardly from the outer free edges of the sidewall portions 4. The members 1 and 2 are connected with one another, but the connectors are known per se and have not been shown in order to simplify the drawing and concentrate attention upon the features of the invention.

In both the inner profile element 1 (which is not shown sectioned, but only so as to distinguish it more clearly from the outer profile element) and the outer profile element 2. The main thickness of the flanges 5 is indicated by reference numeral 52 and corresponds to 0.96 times the thickness 31 of the bottom wall portion 3. The height 51 of the flanges 5 corresponds to 1.33 times the thickness 31 and the minimum thickness 41 of the sidewall portions 4 (immediately adjacent the flanges 5) corresponding to 0.35 times the bottom wall thickness 31.

The bottom wall portions 3 are completely arcuately rounded on their inner sides, i.e. the sides facing the interiors of the respective members 1 and 2. The outwardly directed sides are provided with flats, however, over a dimension 32 which corresponds to 0.42 times the thickness 31 of the bottom wall portions 3. The total width 23 of the inner member 1, respectively the outer member 2, in each case corresponds to 1.06 times the total height 22 of the inner member 1, respectively the outer member 2.

The gap 6 between the two connected profiles 1 and 2 in the region of the sidewall portions 4 increases continuously from an initial smallest width adjacent the flanges 5 to the bottom wall portion 3. The flanges 5 terminate at their side facing away from the sidewall portions 4, in a respective convex ellipsis 53. At their sides facing toward the sidewall portions for the flanges 5 terminate in respective concave ellipsis 54. The concave elliptical flange delimination may be slightly larger than the convex delimination and/or its center point may be offset slightly in the direction towards the center axis or central plane of symmetry 12 of the profile composed of the elements 1, 2. The outer faces of the flanges 5 are formed by two surface portions 55 which are slightly inclined towards one another in roof-shaped configuration and an outward direction.

By resorting to the invention it is now possible to use lighter-weight profile elements for the support of the low-ground excavations, but still to be able to support the same weight as before. At the same time, significant quantities of material are saved as compared to the prior art. Conversely, if the same amount of material is used and the profile elements according to the invention have the same weight as those according to the prior art, then they are capable of withstanding a significantly higher load than those of the prior art. In practical use this means a reduction in the efforts required to transport and install those elements.

Also particularly important in view with respect to the plastic deformability of the profile elements, in accordance with the test requirements of DIN 21 538, the profile element according to the present invention has been found to undergo in almost all regions of the profile cross-section a uniform flowing, so that all regions of the profile element uniformly support weight when plastic deformation begins.

Another advantage is that the glide surface along which the two members making up the profile element side with reference to one another when excess force acts upon them, is between the flanges, and always and only between the flanges. This assures that no problems can arise due to manufacturing tolerances and that the members of the element can be properly connected with one another. The convex and concave ellipsis, and their relationships as described before with respect to the drawing, further provide for slight additional improvements in load-supporting capability, as due to the mutually inclined surface portions at the outer sides of the flanges.

The invention has hereinbefore been described with reference to a particular embodiment as illustrated in the drawing. This is, however, only for purposes of explanation and it is to be understood that various modifications are possible, all of which are intended to be encompassed within the protection of the appended claims.

What is claimed is:

1. An elongated profile element of arcuate cross-section, particularly, for supporting minor excavations, including a member having a reinforced curved bottom wall and arcuate sidewalls provided with free edges and flanges which project outwardly thereof, a mean thickness of said flanges being equal to between 0.9–1.1 times the thickness of said bottom wall, a height of said flanges being equal to between 1.25–1.50 said bottom wall thickness, wherein the improvement comprises a minimum sidewall thickness which is equal to 0.30–0.35 times said bottom wall thickness, said bottom wall having a surface facing outwardly of said element and provided with a flat having transversely of the elongation a width which is at most equal to said bottom wall thickness, and said element having in direction transverse to said elongation a width which is equal to between 0.9 and 1.2 of the overall height of the element; said element deforming plastically and substantially uniformly throughout the regions of the element when subject to stress, so that substantially all regions will upon bending undergo uniform flowing to uniformly support weight when plastic deformation begins.

2. An element as defined in claim 1, being composed of two identical ones of said members, one of which is nested within the other.

3. An element as defined in claim 2, wherein the adjacent sidewalls of the nested-together members define with one another a gap which increases continuously in width from the region of the respective flanges to said bottom wall.

4. An element as defined in claim 1, each of said flanges having a surface facing away from the associated sidewall and being shaped as a convex ellipsis, and another surface facing towards the sidewall and being shaped as a similar but concave ellipsis.

5. An element as defined in claim 4, said concave ellipsis being slightly longer than said convex ellipsis.

6. An element as defined in claim 5, said concave ellipsis also having a center which is slightly offset in direction towards a plane of symmetry midway between said flanges.

7. An element as defined in claim 4, said concave ellipsis having a center which is slightly offset in direction towards a plane of symmetry midway between said flanges.

8. An element as defined in claim 1, said flanges each having a laterally outwardly directed face composed of two portions which are outwardly inclined relative to one another in a roof-shaped configuration.

9. An element as defined in claim 1, and being comprised of two identical ones of said members, one of which is nested within the other; adjacent sidewalls of the nested-together members defining with one another a gap which increases continuously in width from the region of the respective flanges to said bottom wall; each of said flanges having a surface facing away from the associated sidewall and being shaped as a convex ellipsis, and another surface facing towards the sidewall and being shaped as a similar but concave ellipsis; said concave ellipsis being slightly longer than said convex ellipsis; said concave ellipsis also having a center which is slightly offset in direction towards a plane of symmetry midway between said flanges.

* * * * *